US005107728A

United States Patent [19]

Siekierke

[11] Patent Number: 5,107,728

[45] Date of Patent: Apr. 28, 1992

[54] CONTAINER OPENER

[76] Inventor: Dennis T. Siekierke, 1300 Ceape Ave., Oshkosh, Wis. 54901-5426

[21] Appl. No.: 563,063

[22] Filed: Aug. 6, 1990

Related U.S. Application Data

[63] Continuation-in-part of Ser. No. 389,877, Aug. 4, 1989, abandoned.

[51] Int. Cl.[5] ..... B67B 7/40

[52] U.S. Cl. ..... 81/3.27; 81/3.36; 81/3.55

[58] Field of Search ..... 81/3.07, 3.09, 3.25, 81/3.27, 3.36, 3.29, 3.4, 3.31, 3.55

[56] References Cited

U.S. PATENT DOCUMENTS

| | | | |
|---|---|---|---|
| 1,493,543 | 5/1924 | Hight | 81/3.27 |
| 1,662,941 | 3/1928 | Simon | 81/3.48 |
| 1,880,985 | 10/1932 | Saunders | 81/3.25 |
| 2,586,351 | 2/1952 | Larimore | 221/67 |
| 2,875,654 | 3/1959 | Straub | 81/3.15 |
| 3,845,675 | 11/1974 | Cook | 81/3.27 |
| 3,942,395 | 3/1976 | Lepage et al. | 81/3.2 |
| 4,524,646 | 6/1985 | Kimberlin | 81/3.55 |
| 4,663,994 | 5/1987 | Hull | 81/3.36 |
| 4,712,454 | 12/1987 | Hull et al. | 81/3.27 |
| 4,774,859 | 10/1988 | Jarvis, Sr. | 81/3.27 |

FOREIGN PATENT DOCUMENTS

| | | | |
|---|---|---|---|
| 8600127 | 8/1987 | Netherlands | 81/3.09 |

*Primary Examiner*—Roscoe V. Parker
*Attorney, Agent, or Firm*—Thomas D. Wilhelm

[57] ABSTRACT

Apparatus for opening lift tab containers. The apparatus comprises a lifting tongue and a side engaging positioner. The lifting tongue is adapted to engage and lift a lift tab on the container and the side engaging positioner is adapted to use the sides of the container to ensure the proper positioning of the container with respect to the lifting tongue. The opening apparatus can comprise a cavity having a drain for draining liquid from the cavity.

27 Claims, 6 Drawing Sheets

CONTAINER OPENER

This is a continuation-in-part of application of Ser. No. 07/389,877, filed Aug. 4, 1989, now abandoned herein incorporated by reference in its entirity.

BACKGROUND OF THE INVENTION

The present invention relates generally to openers for containers, and especially containers having a lift tab. More particularly, the invention relates to beverage container openers that are mounted on a support such that a container can be opened easily while being supported and controlled by only one hand.

Still more particularly, the invention relates to a mounted opener for opening a lift tab container that has an end wall with a tab and an end wall closure that is openable responsively to the tab being lifted.

Present day containers which contain beverages such as soft drinks have end walls with closures that are openable by manipulation of a pivotable tab attached to the container end wall. Such containers are usually intended to be opened by a consumer using the terminal digit of the finger. Initially, the consumer's fingernail, or other portion of the finger, is inserted between the tab and the end wall of the container. Ultimately the fleshy tip of the finger is to follow. Finally, when the tab has pivoted enough to accommodate a larger portion of the end of the finger, the finger is able to assert sufficient leverage to lift the tab to the disposition in which the end closure is forced open.

What manufacturers of lift tab containers had contemplated as a relatively simple and routine task has commonly been problematic. Broken fingernails have resulted from the step of inserting fingernails. Cut flesh has sometimes resulted from the step of pressing against the tab with the fleshy part of the finger. The step of lifting the tab with the end of the finger has often proven virtually impossible for consumers of less than average dexterity, including children, the aged, and the sick and injured.

A plurality of inventions have come forth addressing some of the difficulties associated with manipulation and use of the lift tab. There have been quite a number of patents issued in the last few years where the lift tab is enclosed in some opening which surrounds it and provides for lifting of the tab. Illustrative of these are:

| | |
|---|---|
| 4,253,352 | O'Neal |
| 4,373,223 | Miller |
| 4,416,171 | Chmela et al |
| 4,455,894 | Roberts |
| 4,474,087 | Widman |
| 4,549,451 | Widman |
| 4,583,429 | Kroeger et al |
| 4,660,446 | Soltis |
| 4,667,544 | Milo |
| 4,723,465 | Hughes |
| 4,745,829 | Van Houtte et al |

It is generally known to engage a container tab with a cam-shaped, or wedge-shaped device, as in U.S. Pat. Nos. 4,524,646 Kimberlin; 4,563,919 Sellars; and 4,617,842 Yang.

It is further known to rigidly mount a device for opening a lift tab container, as in U.S. Pat. Nos. 4,590,822 Dusco; 4,712,454 Hull et al; and 4,774,859 Jarvis.

Dusco essentially teaches a wall mounted version of the lift-tab enclosure. Further the enclosure pivots about a shaft so that the tab can be lifted without tipping the container. Jarvis teaches a wedged-shaped rigidly mounted opener.

Illustrative of openers having engaging members which are wider than the ordinary pull-tab are 4,530,260 Holka and 4,455,895 Christensen.

While there has been quite a bit of activity in openers intended for use with a lift tab container, and wherein the art fairly comprehends the concept of rigidly mounting the opener, of moving the container to the opener instead of the moving the opener to the container, and of using ramp/cam action to lift the tab while the container is fully upright, the art is deficient in teaching a means for directing the container toward engagement of the lift tab with the engaging and lifting member on the opener.

Thus it is an object of this invention to provide apparatus for opening a lift tab container wherein the apparatus comprises means for directing the container to an engagement of the lift tab with the lifting means on the opening apparatus.

It is a further object to provide apparatus which is adapted for use alone, or in combination with machines and enclosures which house and dispense lift tab containers containing product such as beverages.

SUMMARY OF THE DISCLOSURE

The invention is directed to apparatus related to opening a lift tab container. The apparatus comprises a lifting means and container side engaging means. The lifting means is adapted to engage and lift a lift tab on the container. The container side engaging means is adapted to cooperate with sides of the container and thereby assist in obtaining the proper positioning of the container with respect to the lifting means.

In some embodiments, the apparatus is adapted to engage the lift tab before engagement of the sides of the container in cooperation with the apparatus.

In other embodiments, the apparatus is adapted for engagement of the sides of the container before engaging the lift tab.

In some embodiments, the apparatus comprises a plurality of the lifting means arranged side by side, and wherein, when one of the lifting means engages the lift tab, at least one adjoining one of the lifting means operates as one container side engaging member. In those embodiments, the apparatus comprises a mounting base, and a representative one of the lifting means preferably comprises an engaging edge remote from the base, and diverging side edges extending from the engaging edge toward the base. The diverging sides can operate as the container side engaging members.

The invention further comprises a machine adapted to dispense containers, and including the opening apparatus sized and adapted to open the containers to be dispensed from the machine. The machine preferably includes an outer enclosure and including an opening in the outer enclosure, the opening being adapted to receive a container and a user's fingers on opposing sides of the container as the container is received in the opening, the lifting means being disposed in an upper portion of the opening.

In some embodiments, the apparatus further comprises a sidewall spaced outwardly and downwardly of one of the container side engaging members, and a cavity between the sidewall and a vertical downward projection of the one container side engaging member, the cavity being adapted to receive a user's fingers when holding a container adapted to be engaged by the container side engaging members. Preferably the apparatus comprises first and second opposing sidewalls, and corresponding first and second opposing cavities, which are readily defined when a container is operatively engaged in the opening.

The opening apparatus can include a bottom wall, with the apparatus being sized and adapted to receive a container between the lifting means and the bottom wall. It is preferred that the container side engaging members be disposed upwardly in the opening apparatus.

In some embodiments, the opening apparatus further includes additional side engaging members disposed downwardly in the apparatus, for engaging sides of the container at lower portions thereof.

In some embodiments, the opening apparatus is installed in cavity of an enclosure, such as a container dispensing machine, such that either sidewalls of the cavity, or sidewalls of the opening apparatus are effectively positioned to engage a user's fingers and thumb on one or both sides of the container as the container is urged toward the lifting tongue of the opening apparatus. Accordingly, the fingers and/or thumb serve as side engaging means and thereby guide the tab of the container to the lifting tongue.

In some embodiments, the opening apparatus, or the surface to which it is mounted, comprises a wall which defines means to drain liquid from the cavity comprising the opener. The drain means can comprise a rear wall which slopes downwardly and forwardly, such that effectively the apparatus is devoid of a bottom wall, whereby liquid spilled from a container, or sprayed therefrom, flows by gravity down the sloping rear wall and to the outside of the opening apparatus. Alternatively the drain means can comprise a bottom wall which slopes downward, from front to rear, to a rear drain hole which communicates with a liquid receptacle inside the dispensing machine to which the opener is mounted.

DETAILED DESCRIPTION OF THE ILLUSTRATED EMBODIMENTS

Figure 1:
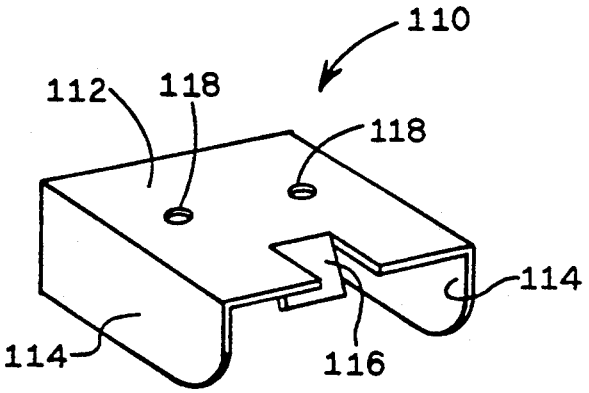
FIG. 1 shows a pictorial view of a container opener of this invention.

FIG. 1 shows a container opener 110 of the invention. The opener comprises a base plate 112, opposing container side engaging members 114 and tab lifting tongue 116. The base plate 112 includes two mounting holes 118.

Figure 2:
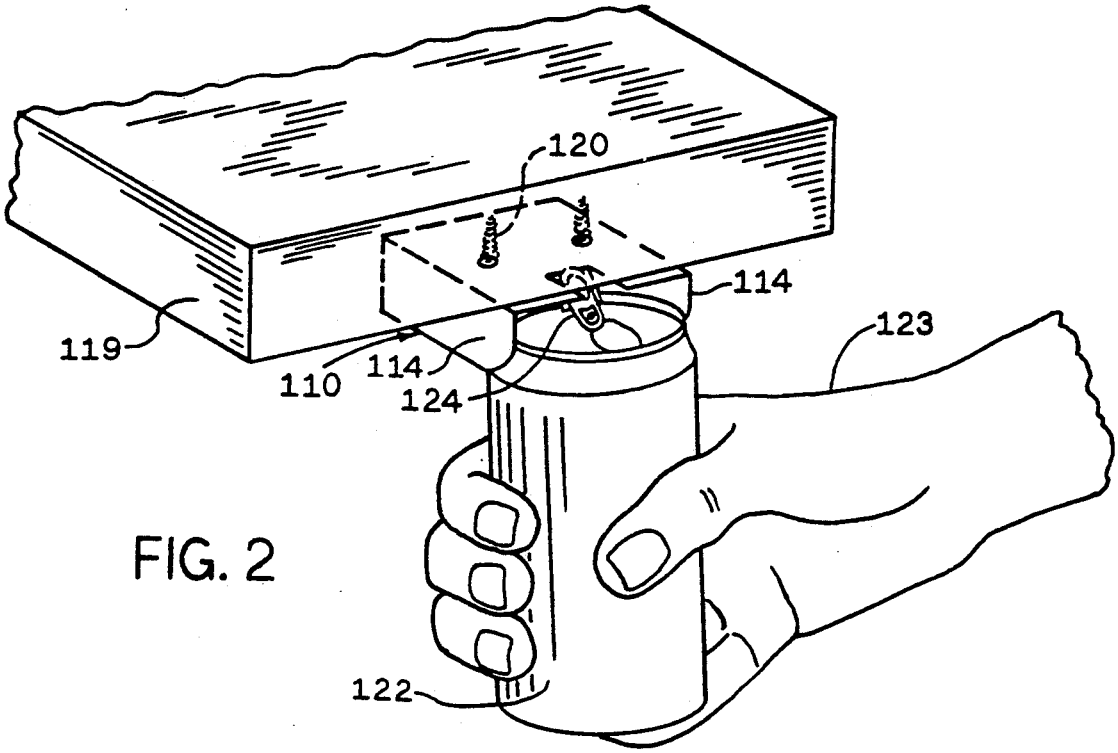
FIG. 2 shows the container opener of FIG. 1 installed under a horizontal counter and opening a lift-tab container.

FIG. 2 shows the container opener 110 mounted to the lower surface of a horizontal counter 119 with mounting screws 120. A lift tab container 122 is shown held by a person's hand 123 with the lift tab 124 engaging the lifting tongue 116. Lift tab 124 is secured to the top of the container in the usual manner by securing means 124A illustrated in FIG. 10. Lift ring 124B is disposed between securing means 124A and the outer edge of the top of the container.

Figure 3:
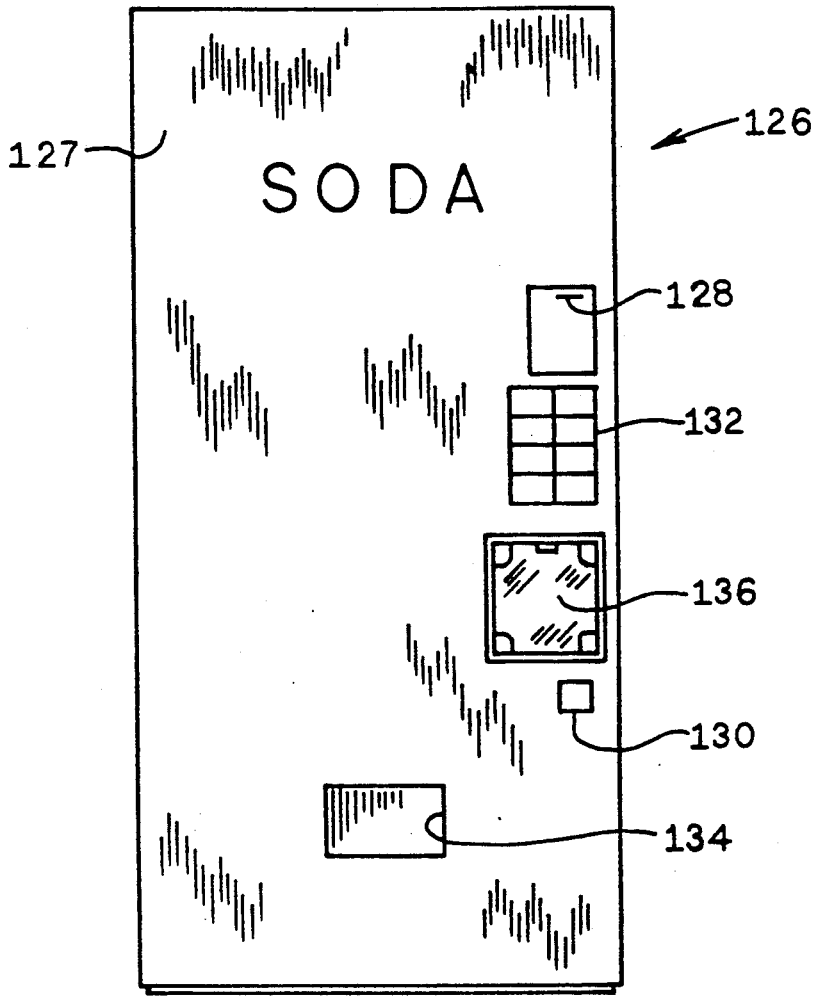
FIG. 3 shows a machine for dispensing containers of soda, including a container opener of the invention.

FIG. 3 shows a soda dispensing machine 126. The dispensing machine has an outer enclosure including a front panel 127. Mounted in the front panel 127 of the dispensing machine are the usual coin receptacle 128, coin return 130, product selection controls 132, and product delivery opening 134. In addition, the front panel 127 includes an opening 135, seen in FIG. 4, for receiving a container opener 136 derived from the opener 110 shown in FIG. 1. Opening 135 can be an enclosed recess in front panel 127, or can be a hole in panel 127. Opening 135 can also comprise a separate containing enclosure, comprising a plurality of walls defining the dimensions of opening 135, and attached to front panel 127.

Figure 4:
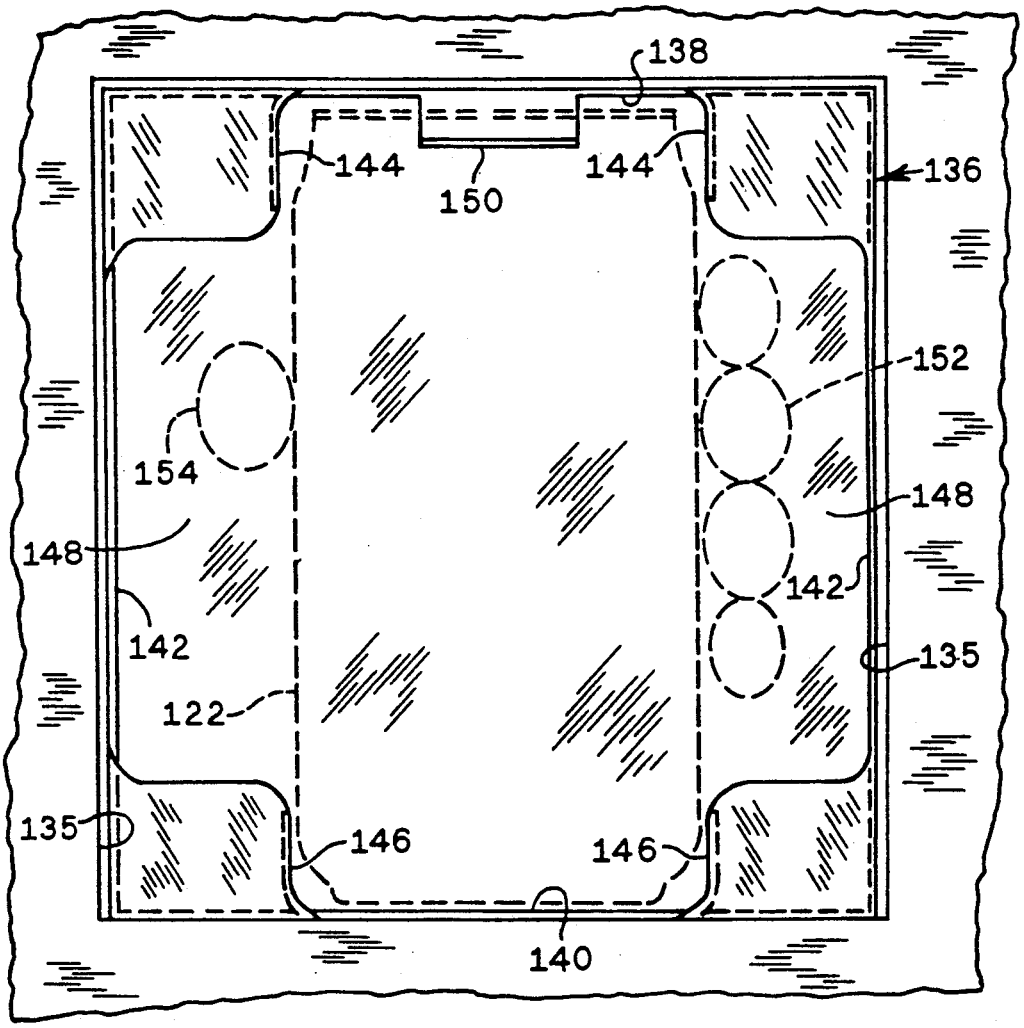
FIG. 4 shows a fragmentary view of the dispensing machine of FIG. 3 and including an enlarged view of the opening in the machine enclosure, and an enlarged view of the container opener.

Container opener 136 includes an upper wall 138 (corresponding to base plate 112 in the embodiment of FIG. 1), and a lower wall 140. Upper and lower walls 138 and 140 are connected to each other by two outer side walls 142. Opener 136 includes upper side engaging members 144 (corresponding to side engaging members 114 in FIG. 1), and lower side engaging members 146. Container opener 136 is shown in FIG. 4 with a container 122 in dashed outline. A pair of cavities 148 between container 122 and outer side walls 142 have adequate room to receive a person's fingers 152 and thumb 154 as shown while the lifting tongue 150 lifts the lift tab on the container.

As an alternative to opener 136 in opening 135, the opener 110 can be attached to an upper structure in the opening, and corresponding in position to upper wall 138 of opener 136. For example, an upper wall, not shown, could depend from front panel 127, or other machine member in such a manner as to receive and mount the opener 110, holding lifting tongue 116 in the position shown for tongue 150 in FIG. 4, with the side engaging members 114 being in the position shown for side engaging members 144 in FIG. 4.

Figure 5A:
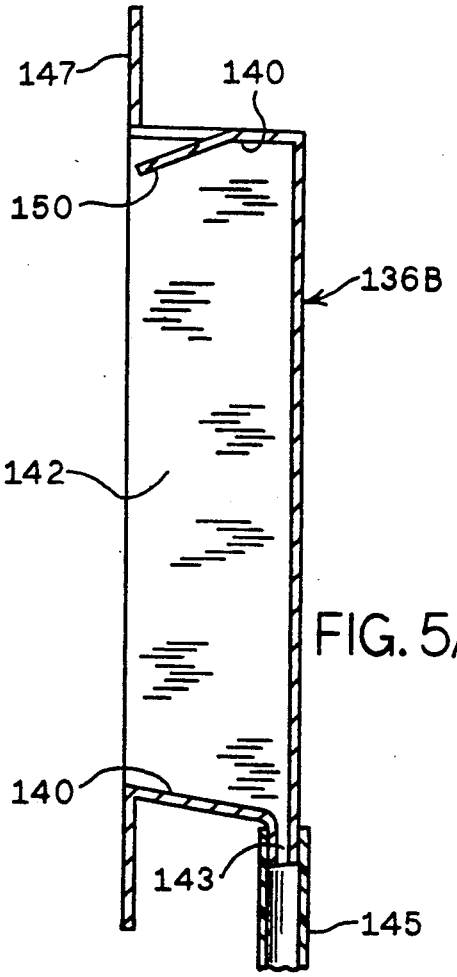
FIGS. 5, 5A, and 6, show alternate embodiments of container openers for use in machines for dispensing containers, or for use with similar mountings.
Figure 5:
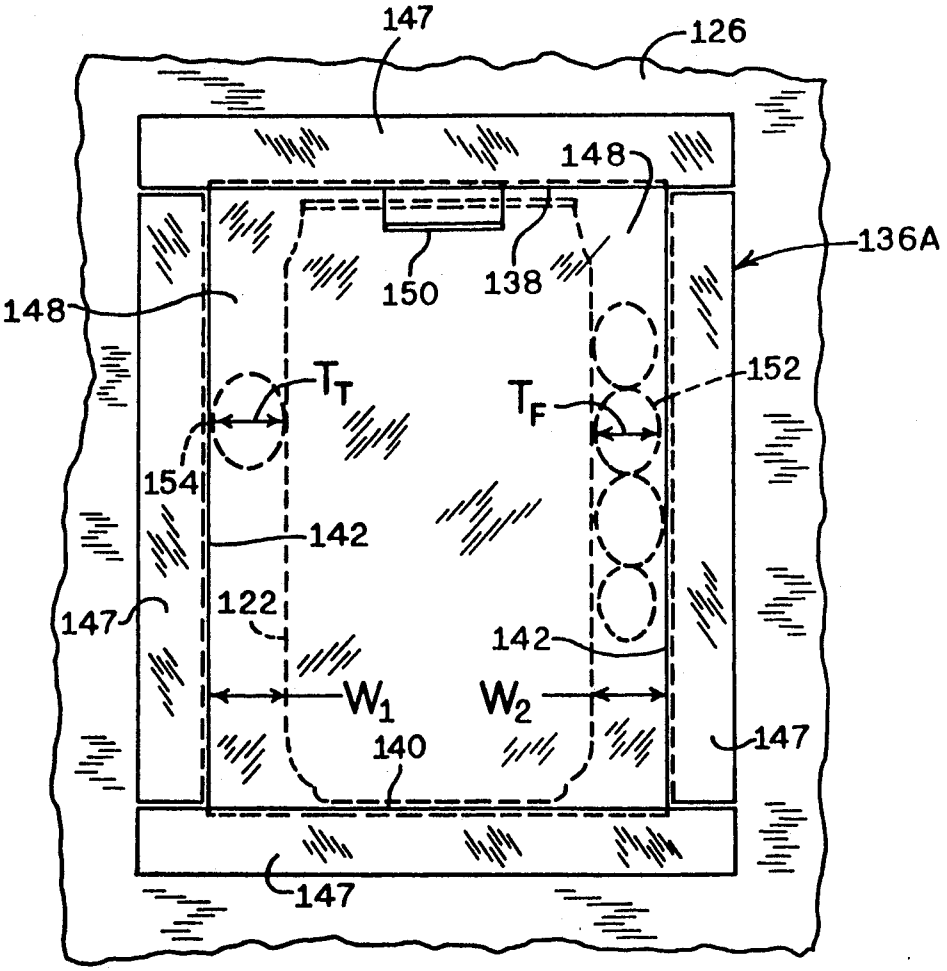

A modified container opener 136A for use in a soda dispensing machine 126 is shown in FIG. 5. Opener 136A is similar to opener 136 of FIG. 4, but without the side engaging members 144 and 146, and with the addition of peripheral flanges 147.

The distance between the two outer side walls 142 is carefully calculated and selected such that the fingers 152 and thumb 154 of the user engage the side walls 142 as the container is urged toward the opener, whereby the lift tab on the container is urged laterally into a position where it will automatically move toward lifting tongue 150 upon further urging of the container into the cavity between the side walls 142. Accordingly, the sum of the widths $W_1$ and $W_2$ of cavities 148, between side walls 142 and the container being opened, is generally equal to, or modestly greater than (e.g. 10%-30% greater) the sum of the thickness ($T_T$ and $T_F$) of the thumb and largest diameter finger of an average adult. If cavities 148 are too small, the typical user will damage his fingers or thumb trying to use the opener. If the cavities are significantly larger, engagement of fingers or thumb will not properly direct the lift tab of the container to the lifting tongue 150. Indeed, with such a larger cavity, engagement of fingers and thumb with the sidewalls 142 may not occur at all. In the embodiments of e.g. FIGS. 4 and 5, the bottom wall 140 of the opener can be modified to slope downwardly and rearwardly of the cavity between sidewalls 142 to a drain hole 143, to which is connected a flexible tub 145 leading to a liquid-collecting receptacle (not shown), as illustrated in FIG. 5A. Any liquid sprayed or spilled in the cavity defined with the opening apparatus is thus contained within the machine, and is emptied when the machine is serviced. Such drain and contain apparatus is preferred on machines which are installed inside buildings and the like.

Figure 6:
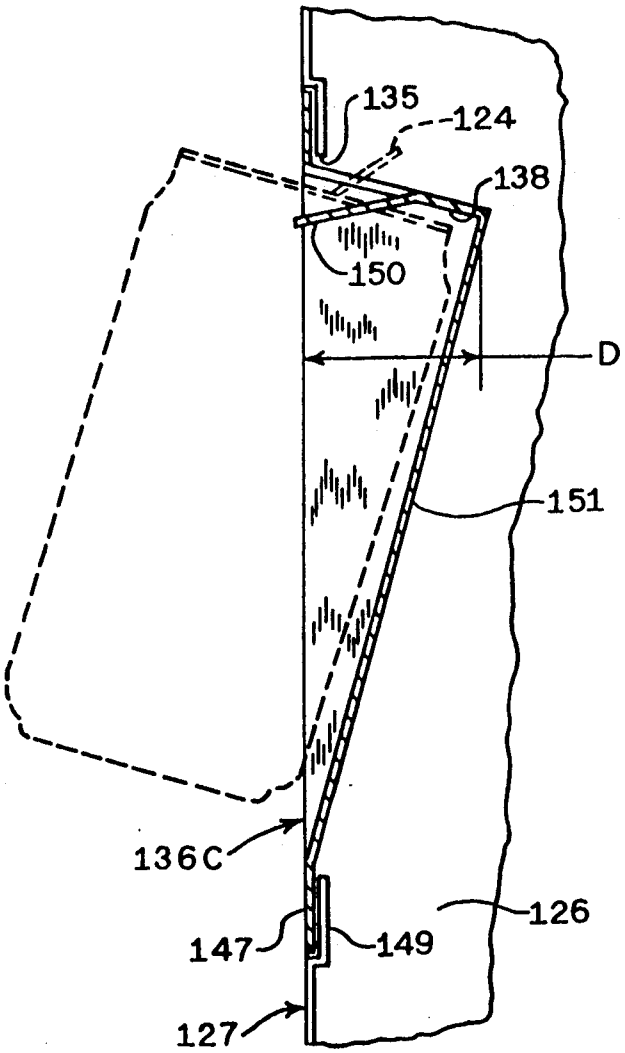

FIG. 6 shows a side cross-section view of a container opener of this invention designated 136C, installed on a soda container dispensing machine 126, with flanges 147 of the opener engaged with corresponding flanges 149 which are coined into the front surface 127 of the machine about opening 135. Opener 136C illustrates the principle of a sloping rear wall 151. As shown, the opener of the embodiment of FIG. 6 does not include side engaging members 144 and 146, so in that regard it most closely resembles the embodiment of FIG. 5. But it can include side engaging members if desired.

In FIG. 6, upper wall 138 reaches to generally the same depth "D" as upper wall 138 in the embodiment of FIG. 5. Upper wall 138 is preferably angled from the horizontal such that upper wall 138 and rear wall 151 form a generally perpendicular angle, although a perpendicular is not critical.

Rear wall 151 slopes, from its joinder with upper wall 138, downwardly and forwardly such that it forms an uninterrupted and generally smooth ramp as it approaches bottom flange 147 at the bottom of the opener. Accordingly, the opener 136C does not have a bottom wall which corresponds to wall 140 of the embodiments of FIGS. 4 and 5.

The sloping of rear wall 151 to bottom flange 147 prevents any liquid, such as spills, or sprays from the opening of pressurized containers, from accumulating in the bottom of the cavity defined with the opening apparatus, since there is no bottom wall on which such material can readily stand and/or accumulate. To the extent thin films of (liquid) material do cling to rear wall 151, and perhaps dry there, the material in e.g. The lower half of the opener is typically reached by the next rain, whereby they are dissolved by the rain water and washed away. Accordingly, the container opener of FIG. 6 is, in general, self cleaning.

A further advantage of the sloping rear wall is that it ensures that the container cannot be tipped with the top of the container disposed outward of the dispensing machine as the container is opened. This ensures that the outwardly-disposed opening locus (where the container opens) cannot be tipped outward/downward as the container is being opened, resulting in spillage of the contents of the container.

Rather, the sloping rear wall 151 ensures the opposite; namely that the opening locus is disposed upwardly, at the uppermost part of the container, as the container is being opened, such that spillage of the container connects during opening is essentially eliminated.

The embodiment of FIG. 6 has a relationship with the embodiment of FIG. 5A in that the embodiments of FIGS. 5A and 6 both provide a sloping wall (140 in FIG. 5A and 151 in FIG. 6) which directs liquid to an exit (hole 143 in FIG. 5A, and the front of the opener in FIG. 6) from the opener. The sloping bottom wall 140 can be combined with a modified rear wall 151 or other support means, whereby the slope of the support assures the beneficial tipping of the container while it is being opened, and the sloping bottom wall assures containment of the draining liquid within the machine. In that combination, the bottom wall is substantially as shown. The rear support may be foreshortened whereby it does not reach the bottom of the cavity, or may have holes, channels, or cut-outs therein, such that the liquid can drain around or through it to bottom wall 140.

The same affect of rear wall slope can be obtained in the embodiment of FIG. 6 by eliminating rear wall 151 of the opener and having a similar wall on the receiving structure (e.g. dispensing machine) as a rear wall of cavity 135. Also, the sloping bottom wall 148 of FIG. 5A could be replaced by a similar sloping wall serving, on the receiving structure, as the bottom of cavity 135. Further, the beneficial affect of finger and thumb engaging sidewalls 142 as disclosed in FIG. 5 can also be obtained by replacing the walls 142 of the opener with similar walls attached to the structure and forming sidewalls of cavity 135. Accordingly, wherever herein in this teaching, and in the following claims, a sidewall, a rear wall, or a bottom wall are recited, such recitation includes within its meaning, in the absence of such wall on the opener, a similar wall attached to the opener or to the structure to which the opener is attached.

As seen in the cross-sections of FIG. 6, lifting tongue 150 depends from the upper wall 138 (corresponding to base plate 112 in the embodiment of FIG. 1), and is fixedly integrated therewith, whereby the upper wall 138 and lifting tongue 150 are portions of a single piece of solid material. Accordingly, lifting tongue 150 is fixedly positioned with respect to the upper wall 138 and is devoid of means to pivot thereabout.

Figure 8:
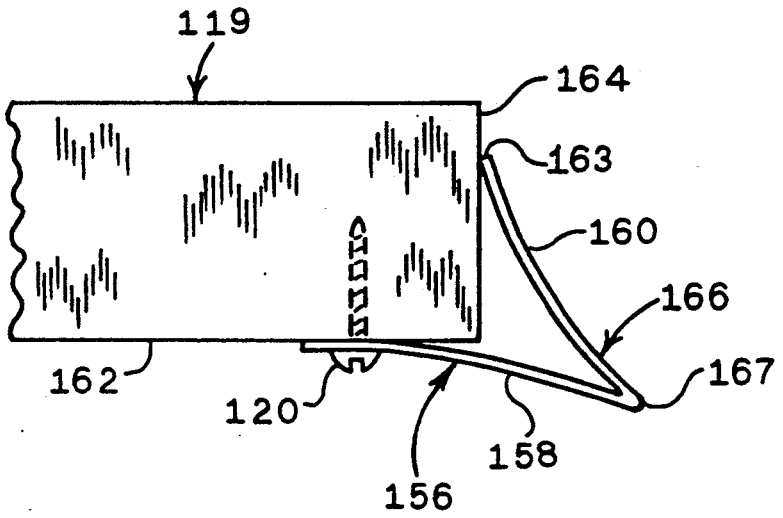
Figure 7:
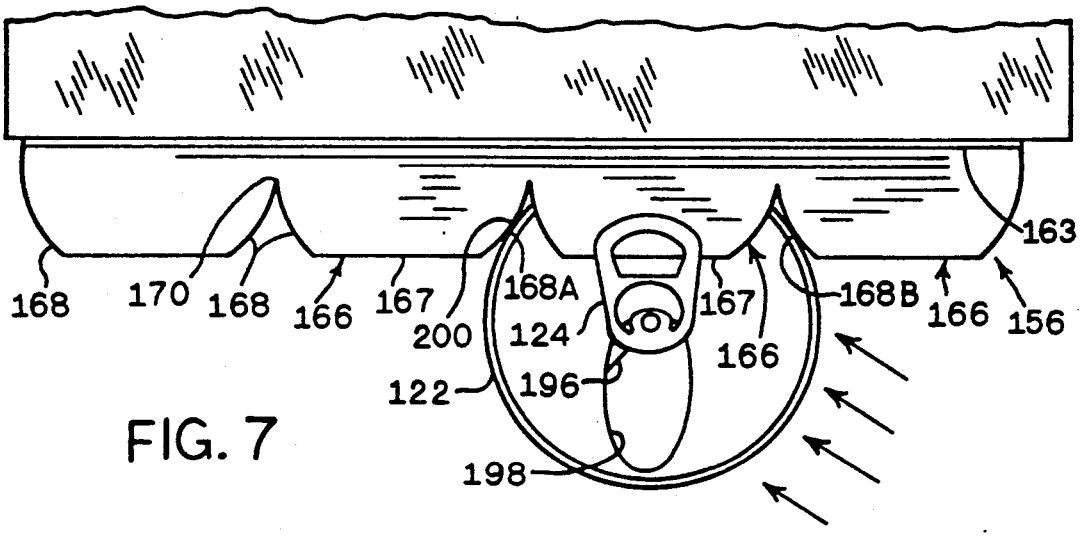
FIGS. 7 .and 8 show another embodiment of container openers of the invention, mounted to a horizontal surface.

FIGS. 7 and 8 illustrate a further embodiment 156 of the container openers of the invention. The container opener 156 comprises a lower strip member 158 and an upper strip member 160. The lower strip member 158 is mounted to the lower surface 162 of bar 119 as shown in FIG. 8. As the opener 156 is mounted to the lower surface 162 of bar 119, the upper edge 163 of upper strip member 160 is urged against the front surface 164 of the bar. The container opener 156 includes a plurality of tab lifting tongues 166 in side-by-side arrangement as shown in FIG. 7. Each tab lifting tongue comprises upper and lower portions embodied in upper and lower strip members 160 and 158 respectively.

Referring now to FIG. 7, each tongue 166 comprises a leading edge 167 and a pair of diverging side edges 168. The diverging side edges 168 of adjacent tongues generally meet at locations 170 spaced from the leading edges of the corresponding adjacent tongues, as shown in FIG. 7.

The preferred method of making the strip opener illustrated in FIGS. 7 and 8 is to bend a corresponding blank of sheet metal into the shape shown in FIG. 8; followed by cutting portions out of both of the upper and lower strip members 160 and 158 to form the side edges 168.

Figure 9:
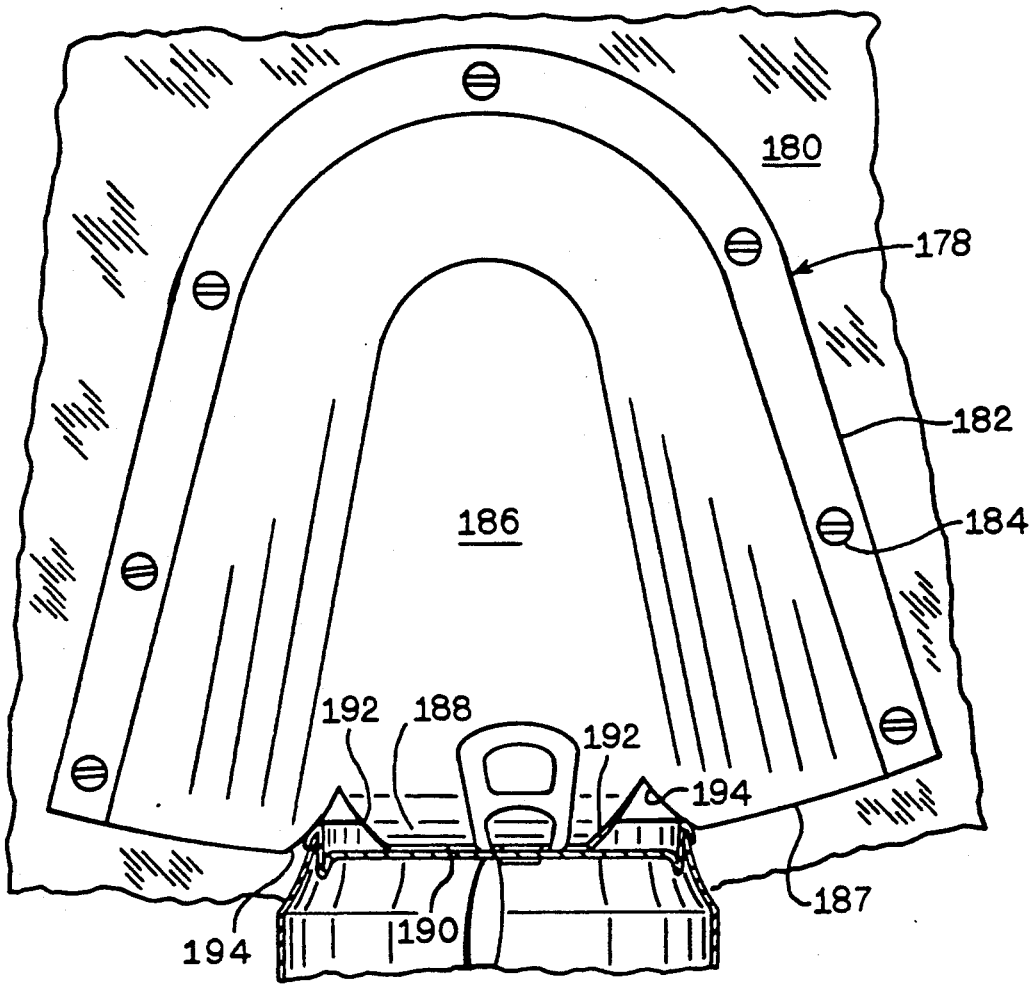
FIG. 9 shows a front view of yet another embodiment of container openers of the invention, mounted to a vertical wall, and opening a lift tab container.
Figure 10:
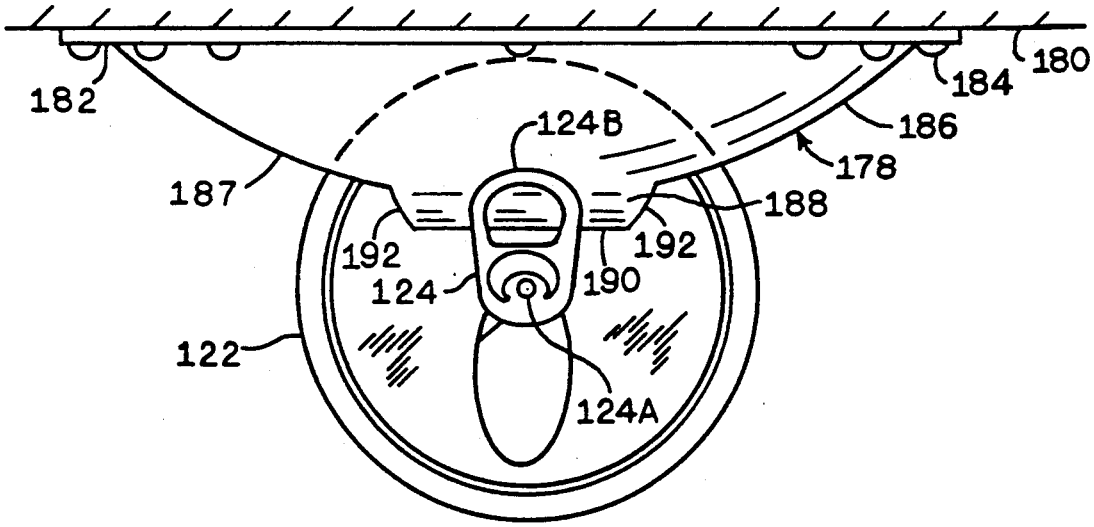
FIG. 10 shows a top view of the container opener and the container of FIG. 9.

FIGS. 9 and 10 show yet another embodiment 178 of the container openers of the invention, mounted to a vertical wall 180. The container opener 178 includes a mounting flange 182 mounted to the wall or other vertical surface by mounting screws 184. An accurately shaped base plate 186 (corresponding to base plate 112 of FIG. 1), is spaced from wall 180, at its bottom edge, a sufficient distance to allow for operation of the opener in opening a lift tab container without interference between the container and the wall. The bottom edge 187 of base plate 186 generally defines an arc with wall 180, in the embodiment illustrated in FIGS. 9 and 10, which arc is illustrated in the top view of FIG. 10. A tab lifting tongue 188 extends from the base plate 186, at bottom edge 187, for engaging the lift tab as shown in FIGS. 9 and 10. The tongue includes a leading edge 190 and a pair of tongue side edges 192. A pair of container side engaging members 194 are disposed on either side of tongue 188 and outwardly thereof, for engaging the sides of the container as shown in FIG. 9. It is seen from FIG. 10 that tongue 188 preferably, but not necessarily, extends in a direction outwardly from the wall, and outwardly from its attachment to base plate 186. Referring to the combination of FIGS. 9 and 10 it is seen that the container side engaging members 194 do not necessarily extend outwardly from base plate 186, but it is acceptable if they do. In either case it is important that the container side engaging members 194 be adapted to engage the side of the container in order to position the container with respect to tongue 188 as seen in FIG. 9.

It is important that tab lifting tongue 188 be spaced from wall 180 a sufficient distance that the container be opened without interference or other engagement between the container 122 and the wall 180, which would impede the opening of the container. Referring back to FIG. 4, and the embodiment wherein the container opener 136 is mounted in a container dispensing machine, it is equally important that the tongue 150 be spaced sufficiently forwardly in the container receiving opening to preclude interfering engagement between the container and a rear wall, if any, of the opening, to the extent such engagement might interfere with the opening of the container by the lifting of the tongue.

Returning now to FIGS. 1 and 2, it is seen that the opener 110 is adapted for mounting to a horizontal surface as shown in FIG. 2. The opener 110 is used to open a container by moving the container such that the lift tab engages the lifting tongue 116. In the process of moving the container into engagement with the lifting tongue 116 any misalignment of the lifting tab 124 with the lifting tongue 116 is automatically corrected by the engagement of the side engaging members 114 with the sides of the container, and especially the container chime as illustrated in FIG. 2. Clearly the side engaging members 114 could extend further down over the sides of the container and thus engage the outer side wall of the container at a lower location.

Generally, side engaging members 114 engage the sides of the container before the lifting tongue 116 engages the lifting tab 124.

The process of opening the container is accomplished as shown in FIG. 2 by pushing the lift tab 124 against the lifting tongue 116 with sufficient force to cause operation of the lift tab 124 in the normal manner whereby the coined openable panel on the top of the container is broken open as illustrated in, for example, FIG. 7, wherein the coined closure 196 has been broken open to expose the container opening 198.

The embodiment shown in FIGS. 3 and 4 is similar to the embodiments shown in FIGS. 1 and 2 in that it has a lifting tongue 150 essentially disposed between upper side engaging members 144. As in FIG. 1, both the tongue 150 and the side engaging members are illustrated as depending from an upper member, which in FIG. 1 is base plate 112 and in FIG. 4 is upper wall 138.

It is contemplated that each of the container openers illustrated at 136, 136A, 136B, and 136C in FIGS. 3–6 could be provided as a self contained unit adapted to be installed in a properly sized opening (e.g. opening 135) in any of a number of supporting structures. Accordingly, the container openers 136, 136A, 136B, and 136C preferably have an upper wall and a lower wall (136, 136A, and 136B only), left and right side walls, and a rear wall; so that the opener comprises a self-contained modular unit. In addition the modular units preferably include the side engaging means as disclosed for the respective embodiments.

It should also be noted that FIG. 4 shows cavities 148 significantly larger than the illustrated fingers and thumb 152 and 154. Applicant contemplates that the distance provided between the sides of container 122 and the outer side walls 142 will be selected by the individual manufacturer according to the space available for providing a cavity 135 on the structure to which the module is to be attached, the range of finger sizes which the manufacturer elects to accommodate, and the side engaging means selected. Thus the width of the container opener can be reduced as shown in FIG. 5, to obtain modest directive interference between the fingers 152, thumb 154, and outer side walls 142.

The modular units as described above, can be installed in an appropriately sized opening in virtually any structural base unit by suitable fastening means such as screws or adhesive, with or without the flanges 147 illustrated in FIGS. 5, 5A and 6. FIGS. 3–6 illustrate the installation of the modular unit on a soda dispensing machine. Applicant contemplates that it could also be easily installed on a refrigerator, an insulated ice chest, other insulated enclosure, or the like.

The embodiments of FIGS. 3–6 operate in a manner very similar to the embodiment of FIGS. 1 and 2, and thus no further description is needed. FIGS. 1 and 2, and 3 and 4, have in common a similar structure for side engaging members 114 and 144. They also have in common the dependence of the tab lifting tongue from an upper supporting member.

Figure 11:
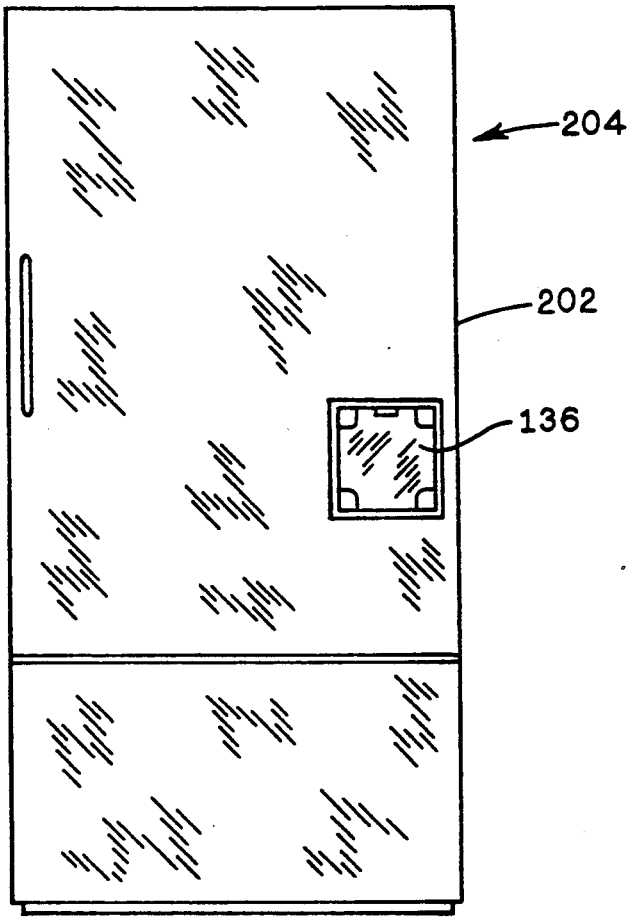
FIG. 11 shows a front view of a refrigerator, including a container opener of the invention.

FIG. 11 illustrates the modular unit 136 (illustrated in FIGS. 3 and 4 as installed in a soda dispensing machine) installed in the door 202 of a refrigerator 204.

Figure 12:
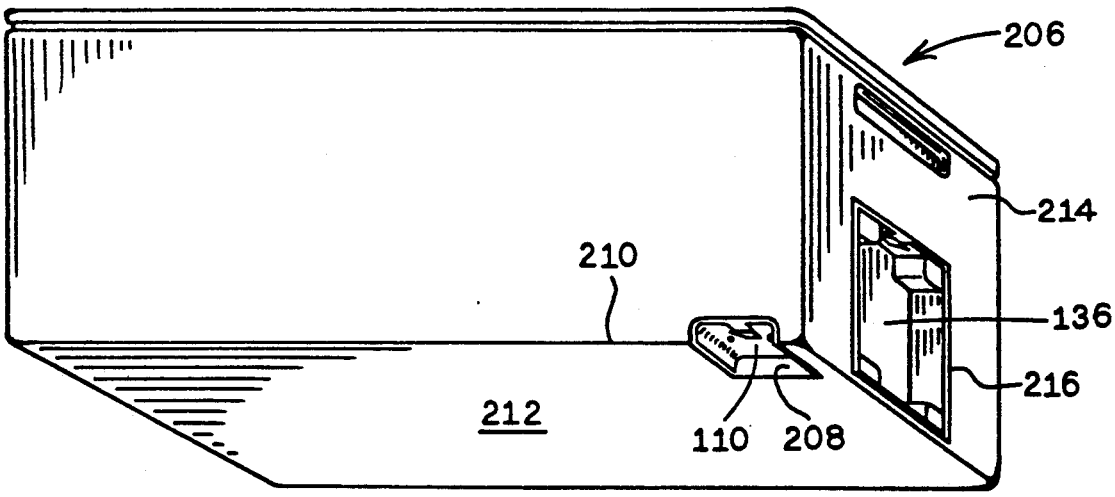
FIG. 12 shows a bottom pictorial view of an insulated ice chest, including container openers as illustrated in FIGS. 1 and 4.

FIG. 12 shows an insulated ice chest 206 illustrating installation of both container opener 110 of FIG. 1 and the modular unit container opener 136 of FIGS. 3 and 4. Modular units 136A and 136C could also be readily used.

Typically, only one container opener will be installed on a given base unit. FIG. 12 shows two container openers on the base unit ice chest, in order to illustrate how each of the embodiments would preferably be used.

Container opener 110 is illustrated as installed in a small opening 208 at the bottom edge 210 of the ice chest. Opening 208 is desirably kept small, and located along a bottom edge 210, in order to minimize, or possibly eliminate the reduction in interior volume of the ice chest. Opener 110 can readily be positioned at an opening, or recess, along any of the edges 210 defining the perimeter of the bottom wall 212. Opening 208, and opener 110, are most preferably juxtaposed along an end wall 214.

Container opener 136 is illustrated as installed in a larger opening, or recess, 216 in end wall 214, and preferably disposed toward bottom wall 212. Opening 216, and opener 136, can be positioned anywhere along any of the upstanding walls of the ice chest.

When using an opening, e.g. 135 or 216, which is at least as tall as the containers to be opened, the modular unit such as at 136 is preferred. However, it is acceptable to use the opener 110, or the like in such openings, and same is included within the scope of this invention.

Openings 135, 208, 216, and the like are defined herein with respect to the primary surface, or surfaces, of the base unit on which they reside. They typically do not open into an inner enclosed space in the base unit. For example, opening 216 represents an opening/discontinuity in the generally planar surface defined by end wall 214, and need not penetrate through end wall 214 into the enclosed and cooled space which serves as the primary cooled containment volume in the interior of ice chest 206.

FIGS. 7 and 8 illustrate an embodiment wherein a plurality of tongues are embodied in, and derived from, upper and lower strips which are joined at a common leading edge (e.g. leading edge 167 of the corresponding tongues). In this embodiment, the sides 168 of adjacent tongues serve as the side engaging members for the tongue located between them. Turning now especially to FIG. 7, it is seen that the lift tab 124 on the container 122 has been engaged by the tongue 166 and lifted.

Turning for a moment back to FIGS. 1 and 2, it is seen that the operation of the opener to open a container 122 depends on the user positioning the container in a location where at least half of the container is between the two side engaging members 114 and disposed in front of the opener, with at least one of the side engaging members 114 in contact with part of the circular surface of the container. An urging of the container into the opening between side engaging members 114, will result in the engagement between the container and the side engaging member moving the container to a central location where the lift tab 124 is engaged by lifting tongue 116.

Returning now to FIGS. 7 and 8, opening a container does not require the initial positioning of the container in contact with a specific one of side engaging members 168. Rather the container can be moved in a lateral direction across the leading edges 167 of the tongues 166, with a simultaneous lifting of the can into engagement with the strip. The leading edge 200 of the top of the container (with respect to the direction of movement) comes in contact with either the leading edge 167 of the one of the tongues, or a side edge 168 of one of the tongues. The arrows in FIG. 5 illustrate a typical movement of the container along the leading edges 167 of the tab lifting tongues 166, and simultaneously an urging toward the tongues. As the container is moved in the direction as shown in FIG. 7 it is lifted into engagement with the opener strip 156. If the leading edge of the container engages the leading edge 167 of one of the tongues, it slides along the bottom of the leading edge 167, after which the lifting force on the container and the continued movement of the container in a lateral direction cause the leading edge of the container to abut against the side edge 168 (illustrated specifically as 168A in FIG. 7) of the adjacent tongue. Thus the diverging side edges of each of the tongues function as side engaging members with respect to operation of the corresponding adjacent tongues.

As seen in FIG. 7 the adjacent side edge 168 causes the positioning of the container such that the leading edge 67 of the tongue adjacent the side edge 168A which stopped the movement of the container will engage the lift tab 124 for opening of the container. The side edge 168B on the opposing adjacent tongue 166 typically engages the opposing container side edge in a similar manner to side edge 168A, whereby lateral movement of the container in either direction is effectively inhibited.

The above described method of using the openers of the embodiment of FIGS. 7 and 8, for opening a container, is highly effective for opening a container quickly without necessarily positioning the container with respect to a given tongue 166.

In another method of using the opener, the top of the container is positioned generally at the elevation of the leading edges 167 and is moved more or less horizontally with respect to a respective leading edge. At the same time, the container is tipped, whereby the lift tab is exposed to the leading edge and is engaged with it.

The strip of side-by-side tongues shown in FIG. 7 is only illustrative of the embodiment with respect to the number of tongues in a given strip. Applicant contemplates that a typical strip will be at least 12 inches long, and perhaps longer. Strips of this type are especially adapted for mounting under a bar, such that the containers can be opened by moving the container laterally along the base of the bar until it engages any one of the tongues and is opened. This allows the user to quickly open the containers without having to be attentive to the lateral position of the can relative to the opener, since the opener embodies such an extended length of the bar. It is contemplated that the strip embodiment shown in FIGS. 7 and 8 will be advantageously used by individuals who have a bar which may be several feet in length and where the serving of the opened containers can occur anywhere along the length of the bar. Thus opener strips can be located strategically at various locations along the bar and the containers can be opened with little attention and effort on the part of the user. It is further acceptable to use an extended length opener strip, and to position it along substantially the entire length of the bar.

Turning now to FIGS. 9 and 10, the embodiment shown illustrates a single lifting tab 188 flanked by side engaging members 194. It is seen that the side engaging members 194 are divergently shaped, similar to the diverging sides 168 of the embodiment shown in FIGS. 7 and 8. However a single tongue 188 is illustrated as in the embodiments of FIGS. 1–4.

In this embodiment (FIGS. 9–10), the positioning of the container is limited to a single tongue as in the embodiments of FIGS. 1–4. The operation of the side engaging members 194, however, is more closely related to the converging side edges 168 of FIGS. 7 and 8. It is seen that tongue 188 generally extends outwardly from the base 186. Container side engaging members 194 can also extend outwardly from the base 186, but such extension is not necessary and is not illustrated in the embodiment of FIGS. 9 and 10.

With respect to the embodiment of FIGS. 9–10, the support configuration provided by mounting flange 182 and base 186 is not critical, whereby other support configuration can be provided, so long as lifting tongue 188 is spaced from e.g. a vertical wall a sufficient distance to preclude impeding engagement between a container to be opened and the wall such that opening of the container would be impeded thereby.

The illustrated embodiments show the mounting of the openers to horizontal support means and to vertical support means, as well as mounting in an opening, as at 135 in e.g. FIGS. 3 and 4. Any of the embodiments can be adapted for mounting to a support structure which is disposed at any angle, by providing appropriate adapting means at the mounting location.

Any of the embodiments of the invention can be adapted for use with a plurality of side-by-side tongues as illustrated in FIG. 8. Especially the embodiments of FIGS. 9–10 could have a plurality of side-by-side tongues.

Applicants have demonstrated prototypes of the invention fabricated from sheet metal using conventional processes. It is contemplated that the openers of the invention can be fabricated from any of a plurality of materials so long as adequate rigidity, stiffness, and strength are provided.

Thus the invention provides a novel container opener which includes a lifting means and container side engaging members adapted to engage the sides of the container and position it with respect to the lifting tab.

Those skilled in the art will now see that certain modifications can be made to the container openers herein disclosed with respect to the preferred embodiments, without departing from the spirit of the instant invention and while the invention has been described above with respect to its preferred embodiments, it will be understood that the invention is capable of numerous rearrangements, modifications, and alterations, and all such arrangements, modifications, and alterations are intended to be within the scope of the appended claims.

Having thus described the invention, what is claimed is:

1. Apparatus for opening a lift tab container, said apparatus comprising:

(a) a lifting means on an upper portion of said apparatus, said lifting means being adapted to engage and lift a lift tab on the container, (b) a pair of sidewalls spaced outwardly and downwardly on opposing sides of said lifting means, and thereby defining a cavity between said sidewalls and containing said lifting means, said sidewalls being spaced far enough apart, and being juxtaposed relative to said lifting means such that said cavity is adapted to receive a user's fingers, and to engage the user's fingers, when (i) holding a container adapted to be engaged by said lifting means to thereby lift the lift tab thereon and open the container, and (ii) urging the container into engagement with said lifting means.

2. Apparatus as in claim 1 wherein the engagement between the container and the fingers, and the engagement between the fingers and said sidewalls, are effective to direct the lift tab on the container into lateral alignment with said lifting means on said opening apparatus.

3. Apparatus for opening a lift tab container, said apparatus comprising:

(a) a first wall means comprising an upper wall, said upper wall comprising lifting means, said lifting means being adapted to engage and lift the lift tab on the container; and (b) a second wall means comprising a wall, said wall of said second wall means cooperating with said upper wall and thereby defining a cavity adapted to receive at least a portion of a container for opening thereof, said cavity having a front for receiving a container into said cavity, a rear, and a bottom, said wall of said second wall means comprising a bottom wall of said cavity at said bottom thereof, said bottom wall extending, from said front of said cavity, downwardly and rearwardly toward said rear of said cavity to a lowest locus thereof, and defining means to drain liquid from said cavity by directing the liquid, along a sloping portion thereof to an opening in said cavity.

4. Apparatus for opening a lift tab container, said apparatus comprising:

(a) a first wall means comprising an upper wall, said upper wall comprising lifting means, said lifting means being adapted to engage and lift a lift tab on the container; and (b) a second wall means comprising a wall, said wall of said second wall means cooperating with said upper wall and thereby defining a cavity adapted to receive at least a portion of a container for opening thereof, said wall of said second wall means further defining means to drain liquid from said cavity by directing the liquid, along a sloping portion thereof, to an opening in said cavity, said second wall means comprising a pair of sidewalls spaced outwardly and downwardly on opposing sides of said lifting means, said cavity being defined between said side walls and containing said lifting means, said sidewalls being spaced far enough apart, and being juxtaposed relative to said lifting means such that said cavity is adapted to receive a user's fingers, and to engage the user's finger when the fingers are (i) holding a container adapted to be engaged by said lifting means to thereby lift the lift tab thereon and open the container, and (ii) urging the container into engagement with said lifting means, the engagement between the container and the fingers, and the engagement between the fingers and said sidewalls, being effective to direct the lift tab on the container into lateral alignment with said lifting means on said opening apparatus.

5. Apparatus for opening a lift tab container, the container having a top thereof and a lift tab on the top of the container, the lift tab comprising securing means securing the lift tab to the top of the container, and a lift ring disposed between the securing means and an outer edge of the top of the container, the lift ring being adapted to be lifted to thereby open the container, said apparatus comprising:

(a) a base:

(b) a lift tongue fixedly positioned with respect to said base, and devoid of means to pivot thereabout, said lift tongue being adapted (i) to engage the lift ring as the lift ring is brought into engaging relationship with said lift tongue, with said lift tongue underlying the lift ring and the lift ring positioned between the securing means and said lift tongue and (ii) to lift the lift ring and thereby to open the container, without movement of said lift tongue relative to said base, as the lift ring is urged against said lift tongue; and (c) positioning means, said positioning means being adapted to provide interaction, on opposing sides of the container, between the container and the opening apparatus, thereby to assist in ensuring proper positioning of the lift ring with respect to said lift tongue, said opening apparatus being adapted to effect opening of the container when the container is brought into engagement with said lift tongue, by movement, primarily laterally, of the container.

6. Apparatus as in claim 5, said apparatus comprising a plurality of said lifting means arranged side by side, and wherein when one of said lifting means engages the lift tab, at least one adjoining one of said lifting means operates as one said positioning means.

7. Apparatus as in claim 6, said apparatus comprising a mounting base, said lifting means comprising an engaging edge remote from said base, and diverging side edges extending from said engaging edge toward said base.

8. Apparatus as in claim 7, said diverging side edges comprising said positioning means.

9. Apparatus as in claim 5, said positioning means comprising side engaging members, said side engaging members being adapted to engage sides of the container, thereby to ensure proper positioning of the container with respect to said lifting means, said apparatus further comprising at least one sidewall spaced outwardly and downwardly of one of said container side engaging members, and a cavity between said at least one sidewall and a projection of said one container side engaging member, said cavity being adapted to receive a user's fingers when holding a container adapted to be engaged by said container side engaging members.

10. Apparatus as in claim 5, said positioning means comprising side engaging members, said side engaging members being adapted to engage sides of the container, thereby to ensure proper positioning of the container with respect to the lifting means, said apparatus further comprising sidewalls spaced outwardly and downwardly of said container side engaging members, and cavities between said sidewalls and projections of said container side engaging members, said cavities being adapted to receive a user's fingers and thumb when holding a container adapted to be engaged by said container side engaging members.

11. Apparatus for opening a lift tab container, said apparatus comprising a plurality of lifting means arranged in side by side relationship, each said lifting means comprising an engaging edge for engaging the lift tab, and diverging side edges extending away from said engaging edge, whereby, when one of said lifting means operates to lift the lift tab on a container, at least one said side edge of an adjoining one of said lifting means operates as an engaging member, adapted to engage the side of the container.

12. A machine adapted to dispense containers, and including opening apparatus mounted thereon, said opening apparatus being sized and adapted to open the containers to be dispensed from said machine, said opening apparatus having a front, and comprising a lifting means, said lifting means being adapted to engage and lift a tab on the container; said opening apparatus further comprising means to provide interaction, on opposing sides of the container, between the container and the opening apparatus, thereby to assist in ensuring proper positioning of the container with respect to said lifting means, said apparatus being adapted to open the container when the container (i) is brought into an engaging relationship with said lifting means by primarily lateral movement of said container, and (ii) is pushed against said lifting means thereby lifting the lift tab and opening the container, said lateral movement being defined between a position wherein said lift tab is outside and generally horizontally adjacent said lifting means, and said engaging position wherein said lift tab and said lifting means are engaged.

13. A machine as in claim 12, said machine including an outer enclosure, and including an opening in said outer enclosure of said machine, containing said opening apparatus mounted therein, said means to assist in assuring proper positioning of the container comprising said opening and said opening apparatus as mounted therein being adapted to receive a container and a user's fingers on opposing sides of the container as the container is received in said opening and engages said opening apparatus.

14. A machine as in claim 12, said means to assist in assuring proper positioning of the container comprising side engaging members adapted to engage sides of the container.

15. A machine as in claim 14, said opening apparatus further comprising sidewalls spaced outwardly and downwardly of said container side engaging members, and cavities between said sidewalls and vertical projections of respective ones of said container side engaging members, said cavities being adapted to receive a user's fingers and thumb when holding a container dispensed by said machine.

16. A machine as in claim 12, said opening apparatus including a bottom wall, said apparatus being adapted to receive a container, dispensed by said machine, between said lifting means and said bottom wall.

17. A refrigerator including an opening apparatus for opening lift tab containers, said opening apparatus having a front, and comprising a lifting means, said lifting means being adapted to engage and lift a tab on the container, said opening apparatus further comprising means to provide interaction, on opposing sides of the container, between the container and the opening apparatus, thereby to assist in ensuring proper positioning of the container with respect to said lifting means, said apparatus being adapted to open the container when the container (i) is brought into an engaging relationship with said lifting means by primarily lateral movement of said container, and (ii) is pushed against said lifting means thereby lifting the lift tab and opening the container, said lateral movement being defined between a position wherein said lift tab is outside and generally horizontally adjacent said lifting means, and said engaging position wherein said lift tab and said lifting means are engaged.

18. A refrigerator as in claim 17, said refrigerator including a outer enclosure, and including an opening in said outer enclosure, containing said opening apparatus mounted therein, said means to assist in assuring proper positioning of the container comprising said opening and said opening apparatus as mounted therein being adapted to receive a user's fingers on opposing sides of the container as the container is received in said opening and engages said opening apparatus.

19. A refrigerator as in claim 17, said means to assist in assuring proper positioning of the container comprising side engaging members adapted to engage sides of the container.

20. A refrigerator as in claim 19, said opening apparatus including a bottom wall, said apparatus being adapted to receive a container between said lifting means and said bottom wall.

21. A refrigerator as in claim 19, said opening apparatus further comprising sidewalls spaced outwardly and downwardly of said side engaging members, and cavities between said sidewalls and projections of respective ones of said container side engaging members, said cavities being adapted to receive a user's fingers when holding a container.

22. An ice chest including a container opening apparatus for opening lift tab containers, said opening apparatus having a front, and comprising a lifting means, said lifting means being adapted to engage and lift a tab on the container, said opening apparatus further comprising means to provide interaction, on opposing sides of the container, between the container and the opening apparatus, thereby to assist in assuring proper positioning of the container with respect to said lifting means, said apparatus being adapted to open the container when the container (i) is brought into an engaging relationship with said lifting means by primarily lateral movement of said container, and (ii) is pushed against said lifting means thereby lifting the lift tab and opening the container, said lateral movement being defined between a position wherein said lift tab is outside and generally horizontally adjacent said lifting means, and said engaging position wherein said lift tab and said lifting means are engaged.

23. An ice chest as in claim 22, said ice chest including an outer enclosure, and including an opening in said outer enclosure, containing aid opening apparatus mounted therein, said means to assist in assuring proper positioning of the container comprising said opening and said opening apparatus as mounted therein being adapted to receive a user's fingers on opposing sides of the container as the container is received in said opening and engages said opening apparatus.

24. An ice chest as in claim 23, said means to assist in assuring proper positioning of the container comprising side engaging members adapted to engage sides of the container.

25. An ice chest as in claim 24, said opening apparatus including a bottom wall, said apparatus being adapted to receive a container between said lifting means and said bottom wall.

26. An ice chest as in claim 24, said opening apparatus further comprising side walls spaced outwardly and downwardly of said side engaging members, and cavities between said sidewalls and projections of respective ones of said container side engaging members, said cavities being adapted to receive a user's fingers when holding a container.

27. An ice chest as in claim 22, said container opening apparatus being disposed in said ice chest along the bottom thereof, thereby to minimize reduction in interior volume of said ice chest.

* * * * *